United States Patent [19]

Gwynne

[11] Patent Number: 4,691,494

[45] Date of Patent: Sep. 8, 1987

[54] METAL FRAMING SYSTEM

[76] Inventor: Jacob M. Gwynne, 1853 Woodhaven Cir., Sarasota, Fla. 33562

[21] Appl. No.: 749,731

[22] Filed: Jun. 28, 1985

[51] Int. Cl.[4] ..... E04C 3/30

[52] U.S. Cl. ..... 52/729; 52/732

[58] Field of Search ..... 52/720, 729, 732, 639

[56] References Cited

U.S. PATENT DOCUMENTS

| | | | |
|---|---|---|---|
| 1,545,168 | 7/1925 | Schenck | 52/729 |
| 2,664,179 | 12/1953 | Gwynne | 52/729 |
| 2,736,403 | 2/1956 | Gwynne | 52/782 |
| 2,746,780 | 5/1956 | Comino | 52/732 |
| 3,129,792 | 4/1964 | Gwynne | 52/732 |
| 3,381,439 | 5/1968 | Thulin, Jr. | 52/729 |
| 3,565,264 | 2/1971 | Guiher | 52/729 X |
| 3,849,961 | 11/1974 | Gwynne | 52/639 |
| 4,172,677 | 10/1979 | Gunti | 52/732 X |

FOREIGN PATENT DOCUMENTS

| | | | |
|---|---|---|---|
| 650770 | 3/1962 | Canada | 52/729 |
| 1337792 | 8/1963 | France | 52/729 |
| 996341 | 5/1964 | France | 52/578 |
| 356903 | 7/1938 | Italy | 52/729 |

OTHER PUBLICATIONS

"Alcoa Alumiframe Building System", Alcoa Co. of America, Pittsburgh, PA., 1971.

*Primary Examiner*—Carl D. Friedman
*Assistant Examiner*—Naoko N. Slack
*Attorney, Agent, or Firm*—Charles J. Prescott; Raymond H. Quist

[57] ABSTRACT

A metal framing system for building structures wherein the members have continuously roll formed and fabricated "C"-shaped, "T"-shaped, and "I"-shaped cross sections and wherein the flanges at their distal edges excluding plate members, include a roll formed multipurpose end and surface fastener recess extending the length of the member. These recesses are adapted to supportedly receive threaded fasteners for use in conjunction with both interconnection of pre-punched transverse plates at the ends of the members and also for attachment of wall covering against the flanges of the members. This recess and extended distal edge, while providing full functional flange width, also eliminates "Q" column flange loss while substantially stiffening the distal edge of the flange. "C" section studs and joists members may have two additional end fastener recesses added to the webs where a total of four fasteners are required per member for attachment to plates. The plate web includes improved corrugation expansion structure and also includes two parallel spaced rows of spaced apart fastener entering holes which also serve to provide indicia of upright member spacing to the plates connected thereto. The spacing between rows may be adapted to various member section depths. When used in truss cords, as a "T" section, the webs, in addition to having pivot and bearing holes, also include spaced pairs of truss aligning and bearing holes which provide convenient presellected truss slope selection as determined by the lengths of the members, the hole clearance, and bolt diameter.

29 Claims, 17 Drawing Figures

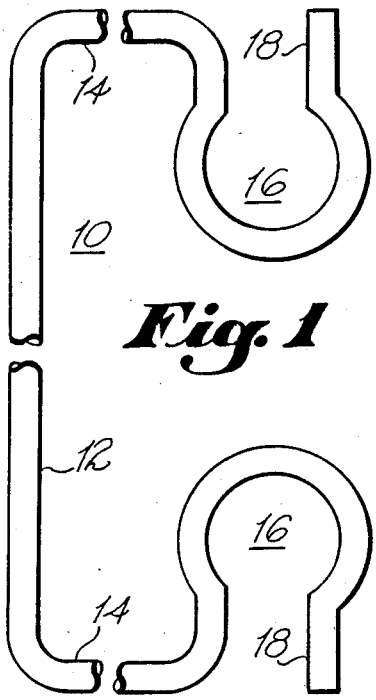
Fig. 1
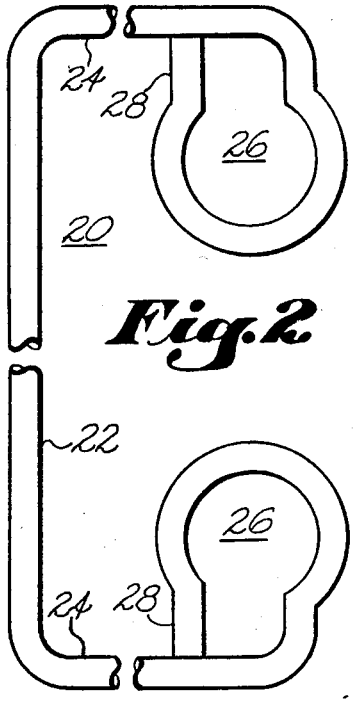
Fig. 2
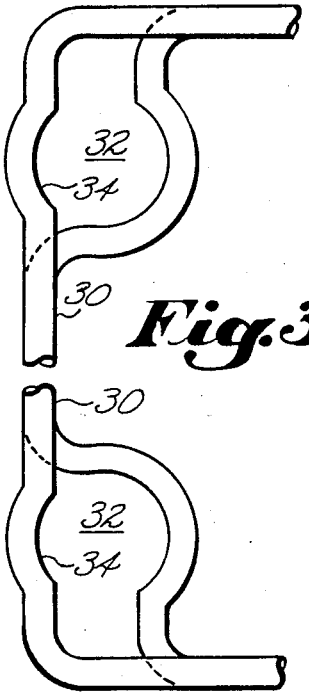
Fig. 3
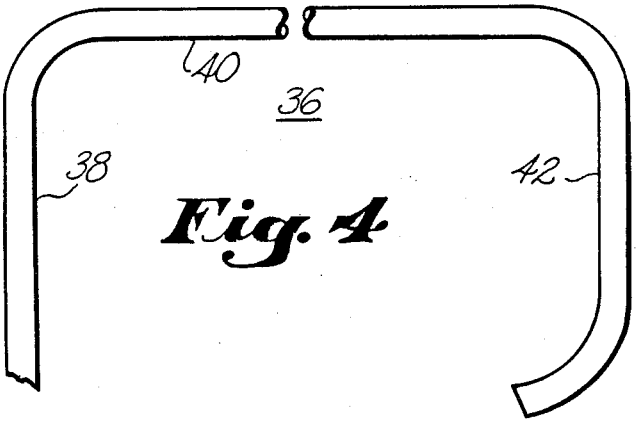
Fig. 4
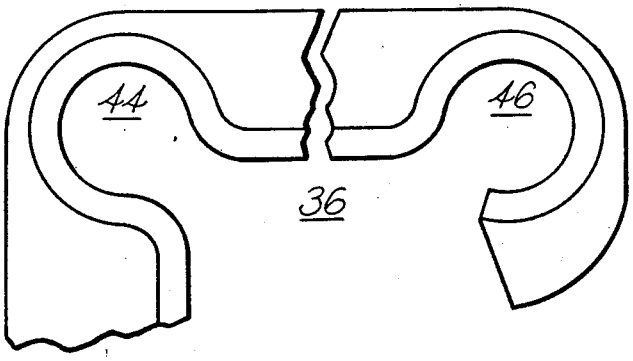
Fig. 5
Fig. 6
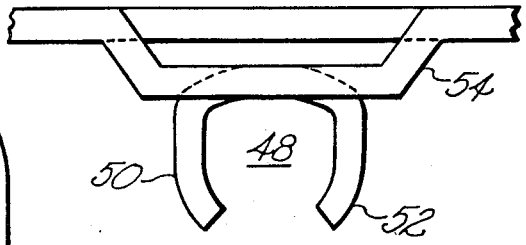

METAL FRAMING SYSTEM

BACKGROUND OF THE INVENTION

1. Field of the Invention

This invention relates generally to framing systems for building structures, and more particularly to improved roll formed metal framing members.

2. Description of Prior Art

Lightweight rolled metal double channel sections welded to form "I" shaped and "C" shaped plates have been available for almost a century, but contain excess metal and are so labor intensive to manufacture that they have not been competitive except in special situations. Roll formed steel framing members having "C" shaped channel sections for concealed construction in the form in which I originally designed them, and in modified forms, are presently being used world-wide but due to high costs have been primarily limited to commercial structures. These sections also contain excess metal for home construction and do not have provision for supportively receiving fastening devices driven into their cross sectional ends, resulting in overpriced and labor intensive products when used as conventional members in homes and other light construction.

That these framing members have excess metal is dramatically demonstrated when a metal frame member is used under axial loading conditions. A computation is performed to determine the amount of the net cross section that may be considered in establishing its load bearing capability. As much as twenty two percent (22%) of the metal included in the net cross sectional area of these sections is excluded in calculating this capability or "Q" column value and is essentially wasted material.

A further deficiency of these sections is that they contain no visual measuring means to indicate the proper spacing of the members to which they are to be joined. Moreover, when threaded fasteners are used to fasten these sections together, the heads of the screws protrude from the plate flange surface which often breaks the drywall placed there against.

Representative of the prior art of metal framing systems are my previous U.S. Pat. Nos. 2,664,179, 2,736,403, 3,129,792, and 3,849,961.

The present invention provides a continuously roll formed metal framing member formed with a web and two flanges extending from the two edges of the web. The distal edges of the flanges are roll formed to provide multi-function edge recesses which will be available for fastening to the flange surface flange recess or to the end of the member, regardless of the length at which it is cut. The improved member of this invention may be further formed by providing additional fastener receiving recesses in the ends of the member at the inside corners between the web and flanges. The web may be expanded and the center portion of the web may also be corrugated before expanding for increased stiffness and formability by extending the corrugations into the unexpanded outer portions of the web. Those members to be used as horizontally disposed plates include two spaced apart rows of holes provided in the unexpanded outer portions of the web for the placing of fasteners therethrough. The holes and rows of holes are spaced at preselected intervals and adapted to provide the visual indicia for the location of studs and joists and, e.g. the center line of an alternate shaped set of four holes, two in each row, matching the end fastener recess pattern in the attached members is provided every eight inches so that two intervals will provide spacing of sixteen inches and three intervals will provide spacing of twenty four inches. Composite members are also formed using wire webs with rolled flanges. Special configurations are provided for truss chords and struts (not shown) which may be conveniently assembled at the construction site and are also provided with preselected punched holes along the length of the webs for lapped truss chord and strut attachment and for assembly into trusses with slopes from zero to ninety degrees.

SUMMARY OF THE INVENTION

The present invention is therefore directed to a metal framing system for building structures wherein the members have continuously roll formed and fabricated "C"-shaped, "T"-shaped, and "I"-shaped cross sections and wherein the flanges at their distal edges include a roll formed multi-purpose end and surface fastener recess extending the length of the member. These recesses are adapted to supportedly receive threaded fasteners for use in conjunction with both interconnection of pre-punched transverse plates at the ends of the members and also for attachment of wall covering against the flanges of the members. This recess and extended distal edge, while providing full functional flange width, also eliminates "Q" column flange loss while substantially stiffening the distal edge of the flange. "C" section stud and joist members may have two additional end fastener recesses added to the webs where a total of four fasteners are required per member for attachment to plates. The plate web includes improved corrugation expansion structure and also includes two parallel spaced rows of spaced apart fastener entering holes which serve to provide indicia of upright member spacing to the plates connected thereto. The spacing between rows may be adapted to various member section depths. When used in truss chords, as a "T" section, the webs, in addition to having pivot bearing holes, also include spaced pairs of truss aligning and added bearing holes which also provides convenient presellected truss slope selection.

It is therefore an object of this invention to provide improved continuously roll formed and fabricated framing members formed of a single sheet in various section configurations wherein each have multi-purpose flange distal edge fastening recesses.

It is another object of this invention to provide continuously roll formed and fabricated framing members having multi-purpose flange edge recesses to receive fasteners driven into the cross section of the ends of the member for interconnection to transverse plates or through the flange's flat surfaces, or recesses, for attachment of wall covering material.

It is another object of this invention to provide improved continuously roll formed and fabricated framing members having multi-function flange distal edge recesses which so function wherever the member is cut to length.

It is another object of this invention to provide additional end fastening recesses added to the inside corners of the web and flanges of the improved framing members which can be formed at the ends of the members at the time they are cut to length and for situations where a total of four fasteners are required per member for attachment to the transverse plates.

It is another object of this invention to provide an alternate embodiment of the flange edge recesses which also further increase the engineering and cosmetic characteristics of the framing members in accordance with this invention.

It is another object of this invention to eliminate or largely reduce excess metal used in calculating the "Q" column factor for axially loaded improved framing members, while maintaining full effective gross flange width and substantially stiffened flange distal edges.

It is another object of this invention to provide a "C" shaped framing member also having four end fastener receiving recesses formed by a separate constrictor die during the cutoff operation.

It is another object of this invention to provide an improved framing member also having special additional end fastener receiving recesses formed preferrably during the cutoff operation for use in special starting and ending panel studs to provide for modular continuity.

It is another object of this invention to provide means in a framing member used as a horizontally disposed plate having indicia in the form of two spaced rows of fastener receiving holes through the web, the spacing between rows adapted to various member section depths, the adjacent hole spacing in each row adapted to facilitate convenient stud and joist spacing at intervals of 1.333" sub-modules of a four inch module or multiples thereof without the need for measuring, marking, locating and jigging operations.

It is another object of this invention to provide continuously roll formed framing members used as horizontally disposed plates having improved corrugation in conjunction with expanded web portions for web lightening, increased rigidity and reduced stress adjacent the ends of the slits required therein for expansion.

It is another object of this invention to provide the above framing member having expanded and corrugated web portions and having the corrugation outwardly disposed in relation to the web exterior surface to provide a full inner bearing surface against the connected studs and joists while providing a flush exterior surface including the heads of threaded fasteners for better truss bearing purposes.

It is another object of this invention to provide improved framing members having I-shaped sections and having webs formed of wire attached to the flanges by resistance welding techniques, the attached flanges having a total of four formed fastener recesses in accordance with this invention.

It is another object of this invention to provide an improved framing member having continuously roll formed flange edge fastener receiving recesses in the form of a double web T-shaped section and also having additional fastener recesses formed at either edge of the double web.

It is another object of this invention to provide the above double web T-truss wherein the additional extended recess in the distal edge of the web is dimpled to receive self-drilling fasteners therethrough for attachment of support strapping.

It is another object of this invention to provide the above framing members having a double web T-shaped section having alternately spaced single large bearing and pivot holes and pairs of smaller added bearing and aligning holes in the web to conveniently facilitate assembly of a truss cord having virtually any desired slope and having additional load bearing interengagement capability.

BRIEF DESCRIPTION OF THE DRAWINGS

FIG. 1 is an end view of a member in accordance with the invention.

FIG. 2 is an end view of another member in asccordance with the invention.

FIG. 3 is an end view of a portion of another member in accordance with the invention.

FIG. 4 is an end view of a portion of another member before an end forming operation.

FIG. 5 is an end view of the portion of the member of FIG. 4 after the end forming operation.

FIG. 6 is an end view of an end fastening detail of a flange in accordance with the invention.

DETAILED DESCRIPTION OF THE INVENTION

Figure 7:
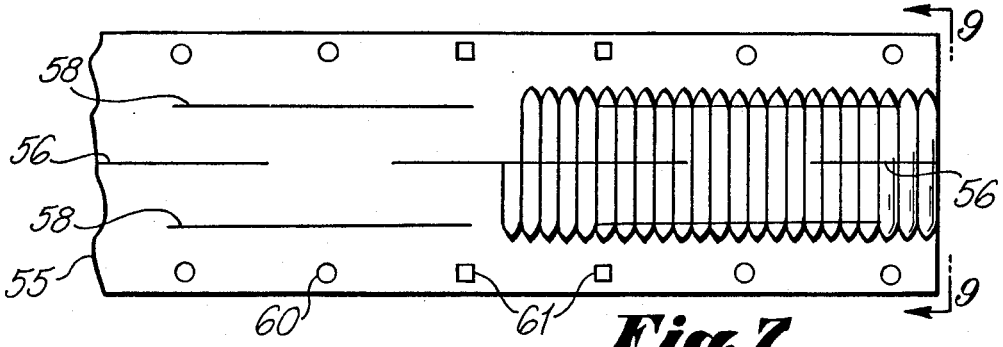
FIG. 7 shows one embodiment of a web for a member in accordance with the invention.

Referring to FIG. 1, an end view of member 10 is shown having web 12 with flanges 14 extending from the edges of web 12. The distal edges 18 of flanges 14 have been curved to form partial circular recesses which extend the length of member 10. These multi-function edge and end fastening recesses 16 have a diameter adapted to receive and hold nail shanks or threaded fasteners of the appropriate size, i.e. having a diameter large enough to cause slight fastener retaining distortion of recesses 16. Recesses 16 will also add rigidity to member 10. These recesses 16 are multi-functioning in that a fastener or nail will be retained therein disposed either axially into the end of the cross sectional recess 16 or transversely into the solid surface of the flange 14, or, into recess 16.

It will be noted that these recesses 16 are located inside the surface of the flange 14 and inwardly disposed towad the center of member 10. Member 10 is roll formed from a length of sheet metal, with steel being preferred because of the lower cost presently. Machinery for roll forming various configurations in sheet metal has long been employed and is illustrated, for example, in U.S. Pat. No. 1,545,168. It will be noted that recesses 16 recurve toward flanges 14 at 18, and that the circular or other shaped curvature extends beyond one hundred eighty degrees to prevent a fastener inserted therein from slipping out of the side of the recess.

A member 10 such as that shown in FIG. 1 has three flat surfaces formed by web 12 and opposing flanges 14 to which plaster board or drywall may be fastened when it functions as a stud. Alternately, web 12 need not have a solid surface but may include lightening holes or may be expanded or formed of wire as will be described herebelow in which case it will only have two flange areas for the attachment of cover materials. It will also be noted that recesses 16 have extensions 18 which will provide additional support in conjunction with the flanges outer surfaces for supporting drywall or sheathing.

Although for most purposes it is preferable that the recesses 16 be formed along the entire length of member 10, such recesses may alternately be formed only at the ends of member 10 in conjunction with a cutoff operation. The metal used in the portions of flanges 14 which form recesses 16 is used in calculating engineering characteristics and is thus well utilized. The recess foreshorten the flange width eliminating the "Q" column losses in the flanges. In effect, a column having greater load bearing capability results from this configuration.

Turning to FIG. 2, an end view of member 20 is illustrated having web 22 with opposing flanges 24 extending from the edges of web 22. The distal edges of flange 24 have been curved to form end fastening recesses 26. As described with respect to FIG. 1, recesses 26 typically extend the length of member 18 and the curvature, preferrably circular, extends beyond one hundred eighty degrees. Also, as in FIG. 1, the recesses 26 are located at the sides of flanges 24, and disposed inwardly toward the center of member 20 so as not to protrude beyond the outer surfaces of the flanges 24. The distal edges of the flange 24 form extensions 28 of recesses 26. Extensions 28 abut flanges 24 providing additional covering material support for flanges 24. As in FIG. 1, embodiment 10, the metal used in forming recesses 26 contributes to the engineering characteristics calculation and eliminates the "Q" column losses in the flanges.

FIG. 3 shows an end view of an optional end recess configuration 32 at the interior corners between web 30 and the flange and only at the ends of the member. Where the member is to have end fastening at four points rather than only at the edge recesses 16 or 26 as in FIG. 1 and FIG. 2 formed at the distal edges of the flanges, additional recesses 32 can be formed by deforming the ends of the member using metal from the web 30 to make these additional end fastening recesses 32. Web 30, at a short distance from the ends of the member, e.g. one half or three quarters of an inch, is punched to form the partial circular recesses 32 while the ends of the strip remain attached to the web. The undeformed portion of web 30 may be formed to provide the opposed sides 34 of the end recess 32 to enhance surface engagement with an end fastener. The opposed sides 34 will therefore be positioned on both sides of the punched, partial circular recesses 32.

It is recognized that the forming of recesses 32 will slightly weaken framing member in FIG. 3 in load bearing capability. However, the insertion of the end fastener into recesses 32 will compensate for this loss. The use of four fasteners for interconnection of studs and joists to plates may be required in the area subject to earthquakes or hurricanes. Four fasteners are required to fasten trusses at the eaves.

FIG. 4 shows an end view of a portion of a member 36 having the distal edge of one flange 42 rolled, and also having web 38, flange 40, and lip 42. FIG. 5 shows the end view of member 36 as further formed to have end fastening recesses 44 and 46. This member 36 is rolled without edge fastening recesses, and at the flying cut-off die or saw, the end of one member and the beginning of the next member are thusly formed to provide these end fastening recesses 44 and 46. It should be noted that the end configurations of FIG. 5 use the same cross section area of metal as in FIG. 4 before forming and provide four end fastener recesses 44 and 46.

FIG. 6 shows a detail of a flange of a member in which end fastening recess 48 has been formed by opposing strips 50 and 52. Strips 50 and 52 have been punched from a flange at a location a short distance from the end of the member, e.g. one half to three quarters of an inch. Strips 50 and 52 each have one end which remains attached to flange portion 54 which may, as shown, be displaced from the plane of the flange. This end fastening recess 48 may be used on flanges where end fastening recesses 16 and 26 as shown in FIGS. 1 and 2 cannot be used in situations requiring special starting and ending panel studs.

Turning now to FIG. 7, the unexpanded web portion 55 of a framing member such as those shown in FIGS. 1–5 is illustrated. The framing member of FIG. 7 is configured to be used as a stud, without holes but with distal edge recesses or joist plate, as shown with holes and without distal edge recesses that connecting member horizontally disposed and interconnected at ninety degrees to the studs and joists. Web 55 has been given spaced longitudinal center slits 56 and side slits 58. The portion of web 55 between side slits 58 has been corrugated and a proximal portion of the sides of webs 55 beyond side slits 58 has also been corrugated. Note that corrugation continues along the full length of the finished member. Holes 60 have been punched in the uncorrugated plate web area. These holes 60 are longitudinally spaced at desired intervals to match the preselected spacing for the two or four end fastening recesses of the studs or joists which will be connected thereto. Holes 61 function as a visual measuring indicia or device to establish the correct spacing of studs or joists along the length of the member. Moreover, it is desirable to use holes 61 of different configurations than that of holes 60 for this visual measurement. All holes 60 and 61 are spaced apart an equal amount, e.g. one and one third inches, for stud and joist interconnection with the plates. The four holes 61 of different configuration being intermittently and evenly disposed, e.g. with their patterns center line on eight inch centers, to provide for multiple spacing, e.g. sixteen or twenty four inch stud, joist and truss spacing. Normally, and end fastener will pass through the web holes 60 and 61 without distortion, and then be held by the head of the fastener. The shank of the fastener may then enter the recess into the end of the joist or stud, which recess may have one of the configurations 16, 26, 32, 44, 46, or 48 of the embodiment shown in FIGS. 1–5. Thus, the positioning of the holes 60 and 61 in web 55 of the plates are determined by the recess pattern and depth of members to which they are to be joined.

Figure 8:
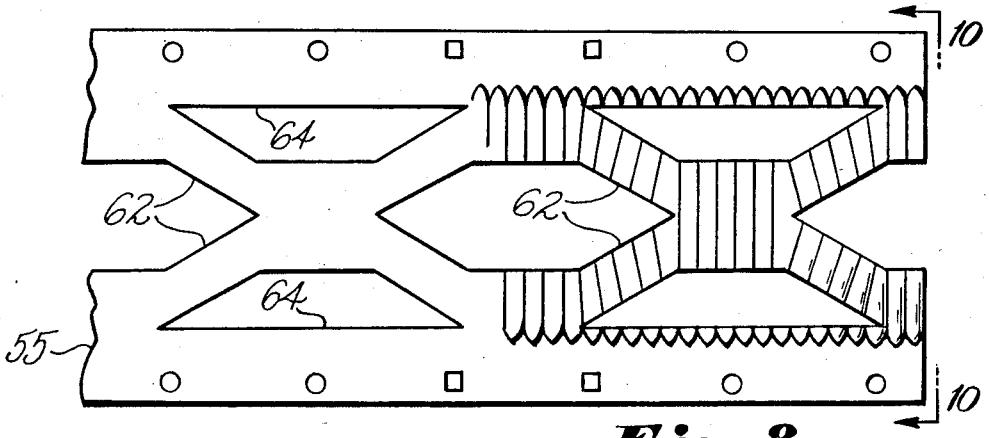
FIG. 8 shows the web of FIG. 7 after it has been expanded.

FIG. 8 shows the web 55 of FIG. 7 after it has been expanded by spreading the sides from each other. After expanding, diagonal ribs 62 connect the side portion 64. The over-corrugations beyond side slits 58 in the ribs 62 facilitate the expanding process, stiffen the web 55 even more so than do longitudinal ribs, and also minimize any tearing of the metal at the ends of slits 56 and 58. The over-corrugations in the side portions 64 are also intended to minimize tearing, particularly at the ends of the slits 56 and 58. The expanded web 55 also provides spacing through which electric wire and plumbing may be passed.

Figure 9:
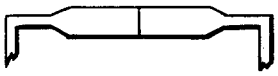
FIG. 9 is an end view of the web of a member in FIG. 7.
Figure 10:
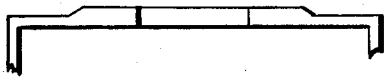
FIG. 10 is an end view of the expanded web of FIG. 8.

FIG. 9 is an end view of the member of FIG. 7 which shows the additional thickness of the web caused by corrugation. FIG. 10 is an end view of the expanded member of FIG. 8. The corrugated portion in the expanded member is not as thick as that in the member before expanding because of material stretching. Expanding, with or without corrugating, provides additional width of the member without requiring additional metal, and also provides convenient passage through the members for conduits or the like without necessitating drilling. It should be noted in FIG. 10 that the corrugations have been forced to the exterior side of the web so as to leave flush inner surface for the ends of members to be fastened and recesses for the fastener heads formed by the outwardly disposed corrugation and outer bearing surface there created.

Figure 11:
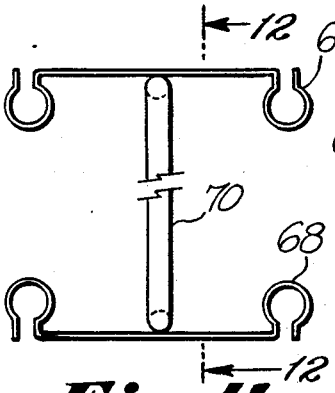
FIG. 11 is an end view of an I-section formed in accordance with the invention.
Figure 12:
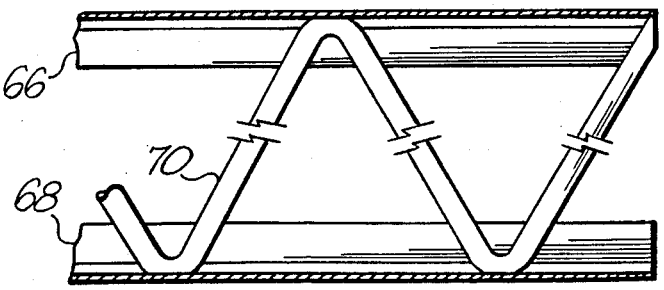
FIG. 12 is a cross section view in the direction of arrows 12—12 in FIG. 11.

Turning next to FIGS. 11 and 12, flanges 66 and 68 have been joined by web 70 to form an I-section. Web 70 may be a continuous length of either solid or hollow cylindrical elongated material which is resistance welded to flanges 66 and 68 at the points of contact formed by the apexes. Welding may be facilitated by forming web 70 to have a height greater than the final height desired. When flange 66 and 68 are then pressed toward each other, compressing web 70, web 70 will be firmly pressed against flanges 66 and 68 and supported against flexing at the moment of the welding operation by the tooling insuring uniformity of welding. Other shapes for web 70 may also be used. It will be appreciated by those in the construction industry that, when plywood is to be glued and screwed to upper flange 66, flange 68 is preferrably made of heavier material to provide a better combined balance. The points of attachment of web 70 to flanges 66 and 68 at the apexes also serve as visual measurements for the location of members to be attached thereto, as the length of the bases equals the nominal depth of the member, 4 inch, 6 inch, 8 inch, etc. It is also to be noted that the web 70 has a minimal amount of metal so that most of the metal is concentrated in the flanges 66 and 68 where it contributes best to the engineering characteristics of the section.

Figure 13:
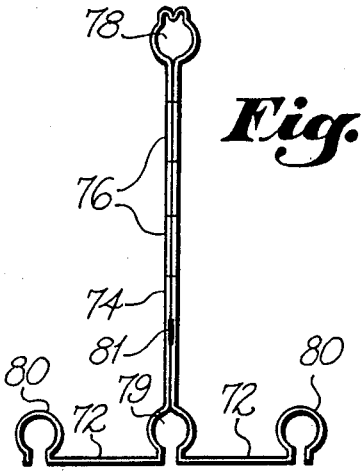
FIG. 13 is an end view of another member having a folded web in accordance with the invention.

FIG. 13 shows a T-section framing member roll formed of a single sheet which will function as a truss chord. The framing member includes double thickness web 74 and flanges 72 whose distal edges are formed into edge recesses 80 in accordance with this invention. The folded web 74 normally will have along its length side holes 76 and, because of the folded structure of web 74, will preferrably also incorporate additional end fastener receiving recesses 78 and 79. Fastener receiving recess 78 has a bulb-shaped section which provides for truss eave fastening to plates. The distal edge of this bulb-section recess 78 is provided with a groove for a short fastener to be inserted therethrough and laterally into the fastener receiving recess 78 to fasten bracing straps in modular position for later use to support other components thereto. Fastener receiving recesses 78 and 79 aids in fastening the gable end studs to the modular punching of gable plates because the slopes of the top plates foreshorten the basic module with which this T-section will fit when the standard stud will not fit at the top in all locations. The folded web 74 has welds 81 at spaced intervals along the length of the member to limit its spreading when fasteners are driven into recesses 79 from the end or from the flange area.

Figure 14:
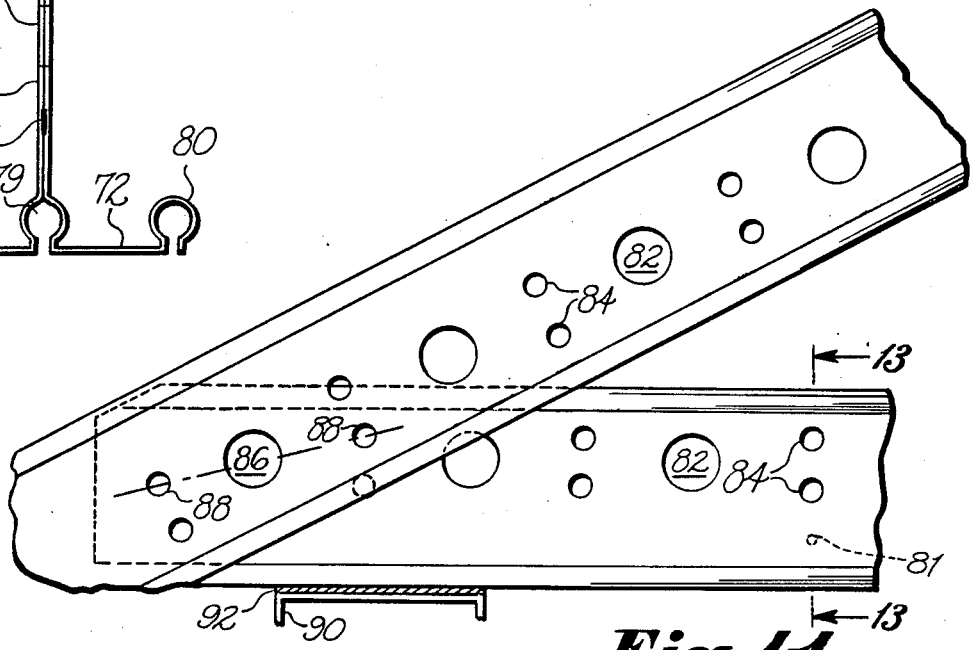
FIG. 14 shows how two members of the type shown in FIG. 13 may be used in forming a truss.

FIG. 14 shows two members of the type shown in FIG. 13 in an opposing interconnected arrangement forming a truss. Both members have large spaced slope pivot and bearing holes 82 and smaller truss angle aligning and added bearing holes 84. The two members are shown aligned so that sloped pivot hole 86 is common to both for pivotal interconnection and for major load bearing and truss angle alignment holes 88 are also in position to receive a bolt therethrough. A standard five-to-twelve sloped truss is shown. Two truss aligning holes 84 as matched at 88 may be through-bolted for added load bearing if required. Slopes of four inches and six inches to twelve inches may be provided by the clearances between bolt and hole diameters. Slopes of three-to-twelve and seven-to-twelve may be provided by using smaller bolt diameters through matching truss angle aligning holes 88. By moving to the next inwardly disposed truss angle aligning holes 84, slopes down to zero inches to twelve inches or flat, may be achieved. To achieve additional load bearing capacity, if required, for greater slopes self drilling and tapping screw bolts may be inserted through the solid common metal in the webs 74.

The overall truss size and slope is predetermined by the precut and end punched tubular or angular struts and chord lengths, ready for assembly wherever cut to multiple modular four inch lengths. The pivot holes 82 are continuously punched through the webs 74 on, four inch centers and the pairs of smaller truss angle aligning holes 84 are also punched, on four inch centers and placed and disposed centrally between larger pivot holes 82. Struts are punched to connect to the smaller truss angle aligning holes 84 nearest the flange 72. Heat insulating washers 92 may also be provided between the other members where attached to the bottom chord to reduce heat transfer between the attic portion and the lower portion of the building structure. Stud plate 90 is shown serving as one support for the truss assembly at the eave, and including heating insulating spacer 92 inserted therebetween to further control the heat flow in the truss assembly from the hot attic space to the ceiling in summer and, conversely, by limiting ground heat distribution upwardly during Winter. Further, there is no need for electrical grounding of metal framed structures, even when installed on a concrete slab.

All of the framing members of this invention provide multi-functioning recesses for receiving nails or other threaded fasteners into the flange surface, into the end fastener recesses in the flanges, and into the ends of the web. When the corrugated and expanded web is utilized for these framing members, waste material is minimized and a light-weight, but strong framing member results.

Figure 15:
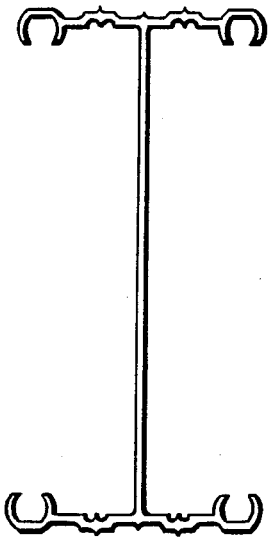
FIG. 15 is an end view of a prior art extruded stud.
Figure 16:
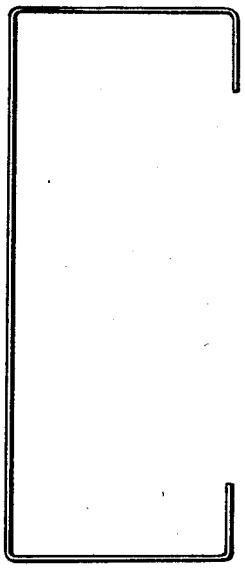
FIG. 16 is an end view of a prior art C-section.
Figure 17:
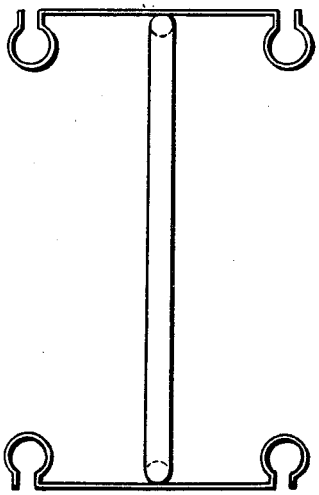
FIG. 17 is an end view of an I-section in accordance with the invention.

FIGS. 15 through 17 show, in approximate scale, end views of an extruded I-section stud as previously designed by me, a rolled C-section member of the type currently available, and an I-section member in accordance with the present invention for use as a stud or joist. The I-section is of the type shown in FIGS. 11 and 12 and, as is clearly shown in FIG. 12, has only a small amount of metal in the web closest to the centroid. Most of the metal is located at the maximum distance from the centroid where it will be most useful in adding to the load bearing capability of the member when used as a stud or column or otherwise having end compressive forces exerted on it.

In use, the required number of standard sizes, metal thickness and lengths of members, with standardized fastening devices, are continuously fabricated in the roll forming operation or added to the ends in conjunction with the cutoff operation and withdrawn from stock as required. Friction fit insulation bats may be readily installed without staples between members and on a continuous basis as the web material is of almost negligible thickness. The small amount of web material conducts less heat per square foot of construction than does normal wood framing, while the full width of insulation provides added insulation over the standard wood framing with insulation between studs.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

I claim:

1. A framing member continuously roll formed from a sheet of material of substantially constant thickness and having an inner and an outer surface comprising:

a generally planar web;

a pair of spaced apart, generally parallel and planar flanges each disposed from a different edge of said web and extending generally at right angles to the plane of said web, so as to form with said web a channel-shaped member with three sides of a generally rectangular cross-section with said outer surfaces, smooth and each lying in a plane;

each of said flanges having inwardly disposed along each distal edge, continuously roll formed curved side walls defining multi-purpose fastening recesses;

said side walls of said recesses having a curved configuration extending through more than 180 degrees;

said recesses terminating in a straight line segment recurved in relation to said curved configuration; and said straight line segment of said recesses ends in the plane of said flange.

2. A framing member in accordance with claim 1 wherein:

each of said flanges has two fastening recesses.

3. A framing member in accordance with claim 2 wherein:

one of said two recesses is formed from material partially punched from said flange.

4. A framing member in accordance with claim 3 wherein:

said material partially punched from said flange forms complementary shaped recess sides.

5. A framing member in accordance with claim 1 wherein:

one of said two recesses is a partial circular recess at the juncture of said web and each of said flanges formed at the end of said member by a strip of material punched inwardly from said member.

6. A framing member in accordance with claim 1 wherein:

said web is folded, and said folded web forms two multi-purpose fastening recesses.

7. A framing member in accordance with claim 6 wherein:

said folded web contains spaced truss pin receiving holes in a hole along the length of said member.

8. A framing member in accordance with claim 7 wherein:

said folded web contains spaced pairs of truss angle aligning holes.

9. A framing member in accordance with claim 1 further including:

a recess formed at the end of said member by deforming the end portion of said web and flanges.

10. A framing member in accordance with claim 1 wherein:

said web has an edge portion adjacent to each of said flanges, and a central portion;

said central portion having diagonal ribs connected to said edge portions formed by slitting said web with laterally and longitudinally spaced cuts parallel to said edges and then expanding said web by moving said edges an additional distance from each other;

said web having lateral corrugations formed therein prior to expanding said web; and said corrugations extending across said web center portion and into a portion of said edge portions.

11. A framing member in accordance with claim 10 further including:

a continuous double row of round fastening holes located in said edge portions at a spaced interval with a set of two adjacent round holes in each row at a multiple of said interval replaced with non-round holes;

said multiple of said interval being the normal spacing of studs, joists and truss chord members.

12. A framing member in accordance with claim 1 further including:

an additional pair of spaced apart, generally parallel and planar flanges each disposed from an edge of said web and extending generally at right angles to the plane of said web in the opposite direction from said pair of flanges, so as to form with said web a member having and "I" cross-section; and each of said additional pair of flanges having end fastening recesses similar to those of said pair of flanges.

13. A framing member in accordance with claim 12 wherein:

said web is a cylindrical member having regular angular bends; and each flange is welded to said web at the apex of alternate ones of said bends of said web.

14. A metal framing member comprising:

a generally planar web;

said web being connected to said flanges along the center-lines of said flanges;

each of said flanges having inwardly disposed along each distal edge, continuously roll formed curved side walls defining multi-purpose fastening recesses;

said side wall of said recesses having a curved configuration extending through more than 180 degrees;

said recesses terminating in a straight line segment recurved in relation to said curved configuration; and said straight line segment of said recesses ends in the plane of said flange.

15. A metal framing member in accordance with claim 14 wherein:

said web is a length of elongated rigid cylindrical material having regularly spaced bends forming apexes of angles; and a first alternate series of said apexes is joined to one of said flanges, and a second alternate series of said apexes is joined to the other of said flanges.

16. A framing member in accordance with claim 15 wherein:

said apexes are joined to said flanges by welding.

17. A framing member continuously roll formed from a sheet of material of substantially constant thickness and having an inner and an outer surface comprising:

a generally planar web;

a pair of spaced apart, generally parallel and planar flanges each disposed from a different edge of said web and extending generally at right angles to the plane of said web, so as to form with said web a channel-shaped member with three sides of a generally rectangular cross-section with said outer surfaces, smooth and each lying in a plane;

each of said flanges having inwardly disposed along each distal edge, continuously roll formed curved side walls defining multi-purpose fastening recesses;

said side walls of said recesses having a curved configuration extending through more than 180 degrees;

said recesses terminating in a straight line segment recurved in relation to said curved configuration; and said straight line segment of said recesses ends abutting said flange.

18. A framing member in accordance with claim 17 further including:

a recess formed at the end of said member by deforming the end portion of said web and flanges.

19. A framing member in accordance with claim 17 wherein:

each of said flanges has two fastening recesses.

20. A framing member in accordance with claim 19 wherein:

one of said two recesses is formed from material partially punched from said flange.

21. A framing member in accordance with claim 20 wherein:

said material partially punched from said flange forms complementary shaped recess sides.

22. A framing member in accordance with claim 19 wherein:

one of said two recesses is a partial circular recess at the juncture of said web and each of said flanges formed at the end of said member by a strip of material punched inwardly from said member.

23. A framing member in accordance with claim 17 wherein:

said web has an edge portion adjacent to each of said flanges, and a central portion;

said central portion having diagonal ribs connected to said edge portions formed by slitting said web with laterally and longitudinally spaced cuts parallel to said edges and then expanding said web by moving said edges an additional distance from each other;

said web having lateral corrugations formed therein prior to expanding said web; and said corrugations extending across said web center portion and into a portion of said edge portions.

24. A framing member in accordance with claim 23 further including:

a continuous double row of round fastening holes located in said edge portions at a spaced interval with a set of two adjacent round holes in each row at a multiple of said interval replaced with non-round holes;

said multiple of said interval being the normal spacing of studs, joists and truss chord members.

25. A framing member in accordance with claim 17 wherein:

said web is folded, and said folded web forms two additional multi-purpose fastening recesses.

26. A framing member in accordance with claim 25 wherein:

said folded web contains spaced truss pin receiving holes in a line along the length of said member.

27. A framing member in accordance with claim 26 wherein:

said folded web contains spaced pairs of truss angle aligning holes along the length of said member.

28. A framing member in accordance with claim 17 further including:

an additional pair of spaced apart, generally parallel and planar flanges each disposed from an edge of said web and extending generally at right angles to the plane of said web in the opposite direction from said pair of flanges, so as to form with said web a member having an "I" cross-section; and each of said additional pair of flanges having end fastening recesses similar to those of said pair of flanges.

29. A framing member in accordance with claim 28 wherein:

said web is a cylindrical member having regular angular bends; and each flange is welded to said web at the apex of alternate ones of said bends of said web.

* * * * *